US006385872B1

(12) United States Patent
Mieger et al.

(10) Patent No.: US 6,385,872 B1
(45) Date of Patent: May 14, 2002

(54) RAPID COUPLING FOR EXCAVATION IMPLEMENTS

(75) Inventors: Rolf Mieger, Oberopfingen; Thomas Zitterbart, Dietenheim, both of (DE)

(73) Assignee: Liebherr-Hydraulikbagger GmbH, Kirchdorf/Iller (DE)

( * ) Notice: Subject to any disclaimer, the term of this patent is extended or adjusted under 35 U.S.C. 154(b) by 0 days.

(21) Appl. No.: 09/578,581

(22) Filed: May 25, 2000

(30) Foreign Application Priority Data

May 28, 1999 (DE) ..... 299 09 329

(51) Int. Cl.[7] ..... E02F 3/96
(52) U.S. Cl. ..... 37/468; 414/686; 414/723
(58) Field of Search ..... 37/468, 231; 414/686, 414/723; 172/681, 748, 753

(56) References Cited

FOREIGN PATENT DOCUMENTS

| | | |
|---|---|---|
| DE | 2511819 | 10/1978 |
| DE | 93158688 | 3/1995 |

*Primary Examiner*—Christopher J. Novosad
(74) *Attorney, Agent, or Firm*—Dilworth & Barrese LLP

(57) ABSTRACT

The invention relates to a rapid coupling for connection of an implement to an operating arm, with at least one pair of lock pins that are movably guided toward each other in alignment and that can be moved toward and away from each other by a drive and that penetrate into an aligned lock hole in the implement in their extended lock position. According to the invention, pre-centering device are provided to pre-center the retracted lock pins on the lock holes.

20 Claims, 10 Drawing Sheets

RAPID COUPLING FOR EXCAVATION IMPLEMENTS

BACKGROUND OF THE INVENTION

The invention relates to a rapid coupling for connection of an implement to an operating arm and similar, particularly a shovel arm, and the related connecting strap, with at least one pair of lock pins that are movably guided toward each other in alignment and that can be moved toward and away from each other by a drive and that penetrate into an aligned lock hole in the implement in their extended lock position.

Excavators are used for various tasks where there is a need for quick changes of the implements coupled with the boom, such as trench scoop, grabs, hydraulic hammers, wrecking arms and similar, for performance of various tasks. "Implements", in this connection, also includes implement adaptors, shovel drag bearings and similar.

To connect implements to operating arms, various rapid couplings have already been proposed. Thus, for example, DE-PS 25 11 819 shows a rapid coupling in which the implement is linked through pairs of lock pins, on the one hand, to the end of the shovel arm, and on the other, to be able to swing horizontally, to a connecting strap, where the latter can be operated by means of a pivoted lever mounted on the shovel arm through a hydraulic cylinder to swing the implement, and the lock pins form the swing axis for the work implement. To retract and extend the lock pins, a relatively complicated articulated lever with a linked hydraulic cylinder is provided, and the rapid coupling is relatively expensive overall.

Furthermore, a rapid coupling is known from DE-U-93 15 868 that is integrated into an implement adapter, to couple the corresponding implement to the implement adapter. Such an implement adapter has a disadvantageous impact on the maximum useful load and resultant costs; in addition, changes in the geometry of the implement coupling are possible to only a limited extent.

The known rapid couplings need improvement with regard to their ease of handling. In particular, the coupling of the implement is laborious and generally must be manually assisted, in order to be able to guide the lock pins into their current lock position in the lock holes. But this places the corresponding person in the danger zone of the excavator.

SUMMARY OF THE INVENTION

This invention therefore relates to an improved rapid coupling of the type mentioned at the beginning, that avoids the disadvantages of known rapid couplings. In particular, the rapid coupling should be improved with regard to its handling.

According to the invention, this task is solved with a rapid coupling of the type mentioned at the beginning in that pre-centering device are provided to pre-center the retracted lock pins with the lock holes.

An automatic alignment device for the lock pins and the lock holes is provided on the implement, at least to the extent that extension of the lock pins into their lock position is possible. The pre-centering is handled with the lock pins still fully retracted, before they are extended in the pre-centered position. Complete centering can be effected by extending the lock pins, for example, by means of a corresponding conical shape of the lock pins or funnel-shaped introduction bevels on the lock holes. Based on the pre-centered self-alignment of the rapid coupling by means of a movement of the operating arm relative to the implement to be coupled, no manual alignment is necessary. This substantially increases safety since there is no reason to remain in the work area of the excavator.

As a further development of the invention, the pre-centering device form a stop, against which the operating arm can run during its movement relative to the implement. As soon as the coupling section that accepts the lock pins has run against the stop, it is in the coupling position, i.e., the lock pins align with the lock holes. The stop works diagonally to the direction of movement of the lock pins. During coupling, the movement of the operating arm relative to the implement is vertical to the direction of extension of the lock pins, so that the proper position, aligned with the lock holes, is achieved.

A guide to the lock holes is provided particularly for the coupling section on which the lock pins are arranged, where the guide is advantageously formed vertically to the lock holes and forms a stop for the coupling section with the lock pins in said coupling position. While traveling along the guide due to the movement of the operating arm relative to the implement, a stable position corresponding to the coupling position results during the lowering of the guide, in which position the lock pins are aligned with the lock holes. The boom, particularly the end of the corresponding shovel arm or the pertinent connecting strap are placed on the guide, in a particularly simple manner, where the coupling section automatically enters the correct coupling position with the lock holes due to the back and forth motion on the guide.

Pursuant to a preferred embodiment of the invention, the pre-centering device is formed as a web-shaped guide projection, particularly guide strips, arranged in pairs in an implement receptacle in which the coupling section surrounding the lock pins penetrate during coupling. The guide projections project preferably in the direction of motion of the lock pins from the surface of the implement surrounding the lock pins. To achieve the most precise pre-centering possible, each of the lock pins are preferably assigned such a guide projection. The guide projections are particularly marked vertically around the lock holes so that upon pressing the coupling section downward with the lock pins on the projection guides, the pins slide into the proper coupling position. The guide projections or tangents are preferably parallel to each other.

To simplify the insertion of the coupling section with lock pins into the corresponding receptacle on the implement, insertion bevels, acting like funnels, are provided in the further development at the coupling receptacle of the implement and/or at the coupling section surrounding the lock pins. The insertion bevels that, for example, can be formed as a phase on the corresponding edge sections, taper in the direction of insertion of the coupling section into said receptacle on the implement.

The rapid coupling can, in principle, be formed separately from the operating arm, for example, they may be integrated into an implement adapter connected with the operating arm. Preferably, however, the rapid coupling is integrated into the operating arm, particularly its shovel arm, and the related connecting strap. The corresponding implement is therefore coupled directly to the operating arm without a spacer. An adapter, that causes a higher maximum useful load, is not necessary which significantly reduces the price. Another advantage is the ability to change the geometry of the coupling. The distance between the two coupling axes can therefore be changed simply and adjusted to the kinetic requirements, such as, for example, an altered angle or increased force. The lock pins for this are inserted directly into a coupling section of the operating arm, particularly the end sections of the shovel arm and the related connecting strap. Two parallel lock pin pairs are expediently provided that simultaneously act as the hinge pins of two parallel swivel axes for the implement to be coupled. In particular, one pair of pins are placed in the end section of the shovel arm and one pair of pins in the end section of the related connecting strap.

The drive for the extension and retraction of the lock pins can be formed in various manners. Preferably, the lock pins are guided in a rotation-resistant manner into the coupling holes of the corresponding coupling section and provided with left- and right-handed threads into which one spindle connecting the two lock pins is screwed. The spindle can be connected with a drive unit that can actuate the spindle. Preferably, a manual crank drive unit can be mounted on the spindle. If necessary, a motor drive for the spindle can also be provided. Through the simple, slender formation of the drive for the lock pins as a threaded spindle, the lock mechanism can be integrated without problem into the shovel arm and the related connecting strap of the operating arm, without need for large changes in the boom or without resizing this component.

In a further development of the invention, the lock pins and drive can be removed from the coupling holes receiving the same. In particular, they are formed as a one-piece removable cartridge. The lock holes on the implement and the coupling holes into which the lock pins are guided are compatible with conventional pins. This means that instead of the rapid coupling described above, pins for coupling the implement can be steered into it in the conventional manner. This compatibility makes it possible to create the design in such manner that, in mass production, both the lock pins of the rapid coupling and conventional pins can be inserted, with the cost of the components increased only slightly.

According to a further preferred embodiment of the invention, the rotation resistance device, through which the lock pins are introduced into the coupling holes in a rotation-resistant manner, has guides with opposing plate surfaces that penetrate into a longitudinal groove in the lock pins. There is no linear contact between the rotation resistance device and the lock pins due to the plate surfaces. The guides, rather, lie flat on the corresponding wall surface of the guide groove. This also results in only slight surface pressure in the case of rotational forces acting on the lock pins. Wear is substantially reduced, and damage or the deflection of the guide groove into the lock pins is prevented. The lock pins are introduced into the lock holes in a rotatable manner; they form the hinge pins on which the implement swivels. This can result in high rotational forces so that the above plate surfaces are particularly advantageous.

In a further development of the invention, guide pins and annular guide plates surrounding them are provided as rotation resistance, where the plate surfaces are formed on these guide plates. Preferably, two-stage grooves are provided in the lock pins that extend longitudinally along the outer surfaces of the lock pins. The first stage of the guide groove lying radially toward the outside serves to receive the guide plate, while the second, inside stage of the guide groove receives the section of the guide pin extending beyond the plate. In the longitudinal direction of the lock pin, the inside groove has a slight swell to receive the guide pin. It forms a longitudinal stop for the maximum extension of the corresponding lock pin. The rotation resistance device of the lock pin is created, on the other hand, by means of the first stage of the guide groove via the guide plate.

The two-stage formation of the guide groove in the lock pins presents particular advantages: it permits for a more compact arrangement since the larger groove necessarily provided for the guide plate can be open at the inner end of the lock pin. The extension stop is created by the narrower, smaller second stage of the guide groove. Secondly, the guide pin can be placed further from the outlet opening of the coupling hole that accepts the lock pin, while still maintaining the necessary extension path for the lock pin. This makes it possible to provide a seal between the coupling hole and the locking pin at the outer end of the coupling hole, without the guide groove in the lock pin overrunning this seal during extension of the pin.

Catch holes are expediently provided in the lock pins that make those in said screwed-in drive spindle accessible from outside, for example, to be able to insert a manual crank on the drive spindle. Sealing plugs can be inserted, and in particular, screwed into these catch holes in the lock holes from the outside in. This effectively prevents the entry of dirt. In particular, the sealing plugs are free of O rings or other blastomer sealing means, to facilitate use of the rapid coupling even at very high temperatures. Bevel seats can be used to seal the sealing plugs.

To prevent unintentional insertion of the lock pins, for example, as a result of micro-impacts or oscillations, a mechanical insertion stop is provided for the lock pins pursuant to a further preferred embodiment of the invention. The insertion stop positively prevents unintentional insertion of the pins. In principle, the insertion resistance can work directly with the lock pins. Preferably, however, the drive for the lock pins can be blocked by the insertion resistance device in said pins' extended position, i.e., the insertion resistance works positively on the drive. The pin forces here do not work directly on the insertion resistance device; an effective insertion resistance can be created with minor forces by means of blocking the drive.

The mechanical insertion resistance simultaneously provides a control preventing the lock pins from being fully extended. Preferably, the insertion resistance here is formed in such manner that it can be used or activated only when the lock pins are in their fully extended position. Preferably the insertion resistance here is formed as pins that are used in, particularly screwed into, one of the catch holes of the lock pins. The resistance pin here is dimensioned and placed, with reference to its length, in such manner that it prevents the screwing of the drive spindle into the corresponding lock pin and thus the insertion of the lock pin. The insertion resistance device is expediently formed by the above-described sealing plugs.

To prevent premature wear on the lock pins on the implement to be coupled, particularly as a result of the rotation of the lock pins therein, bushings are provided in a further development of the invention.

BRIEF DESCRIPTION OF THE DRAWINGS

These and other characteristics are derived from the claims and the following description and related drawings, based on which a preferred embodiment of the invention is explained in greater detail. The drawings show:

DESCRIPTION OF THE PREFERRED EMBODIMENTS

Figure 1:
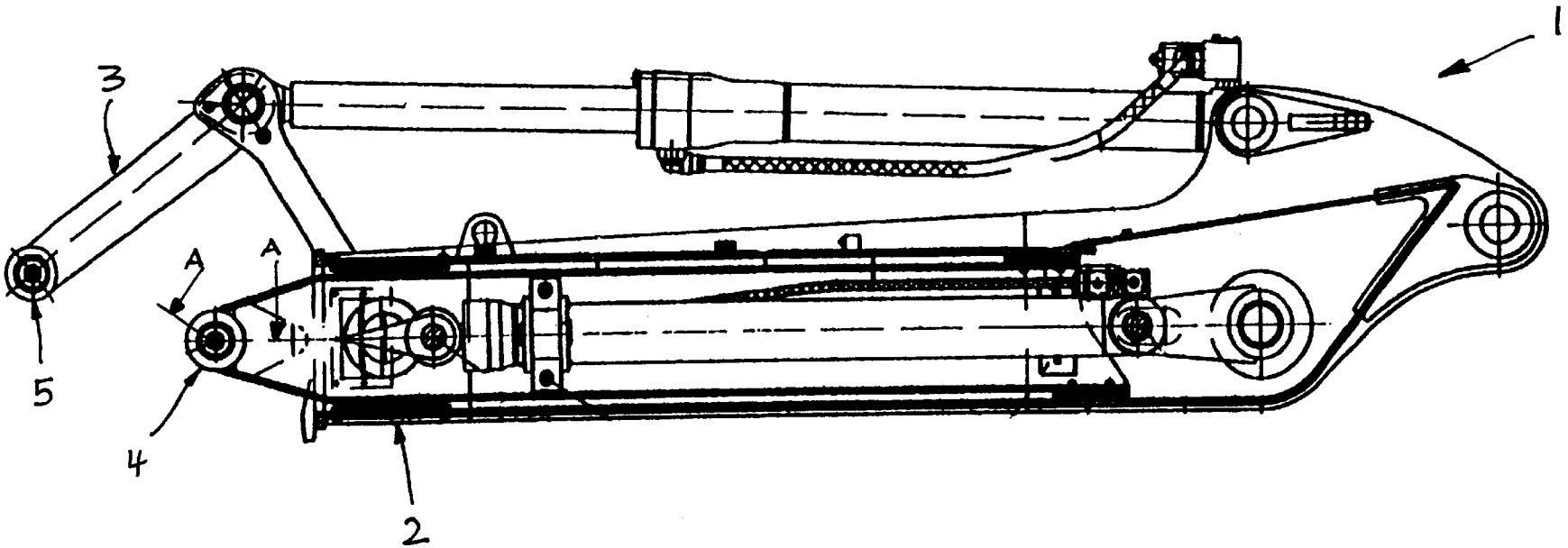
FIG. 1: a side view of an operating arm with a telescoping arm in partial cross-section and a related connecting strap that can pivot relative to the arm by means of a hydraulic cylinder.

The rapid coupling shown is integrated directly into the boom 1, particularly in the arm 2 and the connecting strap 3 thereof, which can be operated by means of a hydraulic cylinder relative to the arm in the usual manner. The ends of the arm 2 and the connecting strap 3 are each formed as the coupling section 4 and 5, in which a pair of retractable and extendable lock pins are inserted (see FIG. 1), as explained below in greater detail.

Figure 3:
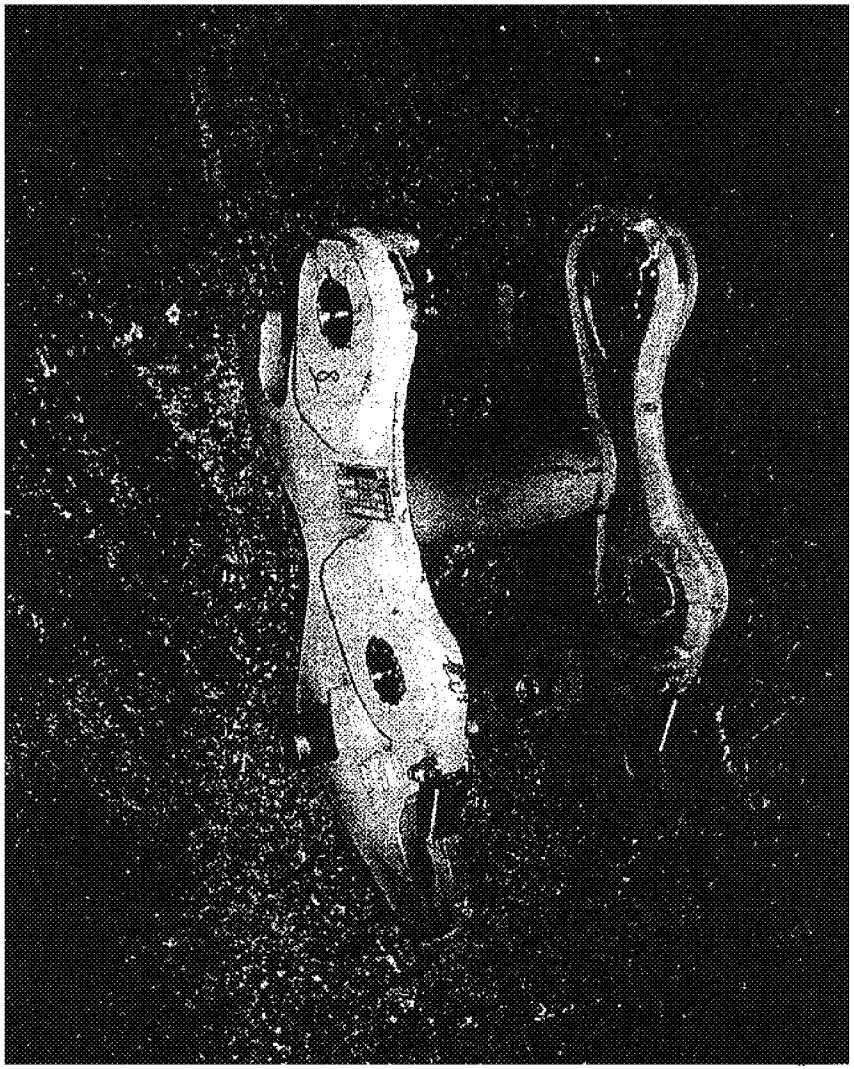

In the embodiment shown, an implement adapter 6 is shown as the implement that can be coupled to operating arm 1 by means of the rapid coupling (see FIG. 3). The implement adapter 6 has, for this purpose, four lock holes 7 that are placed in aligned pairs along parallel axes. As shown in FIG. 3, the lock holes 7 are formed in the spaced plate-like holders 8 extending essentially parallel to each other, between which the operating arm 1 can operate with its arm 2 or connecting strap 3, to couple with the implement adapter 6. The holders 8 therefore form a receptacle for the coupling sections 4 and 5 of the operating arm 1.

Figure 2:
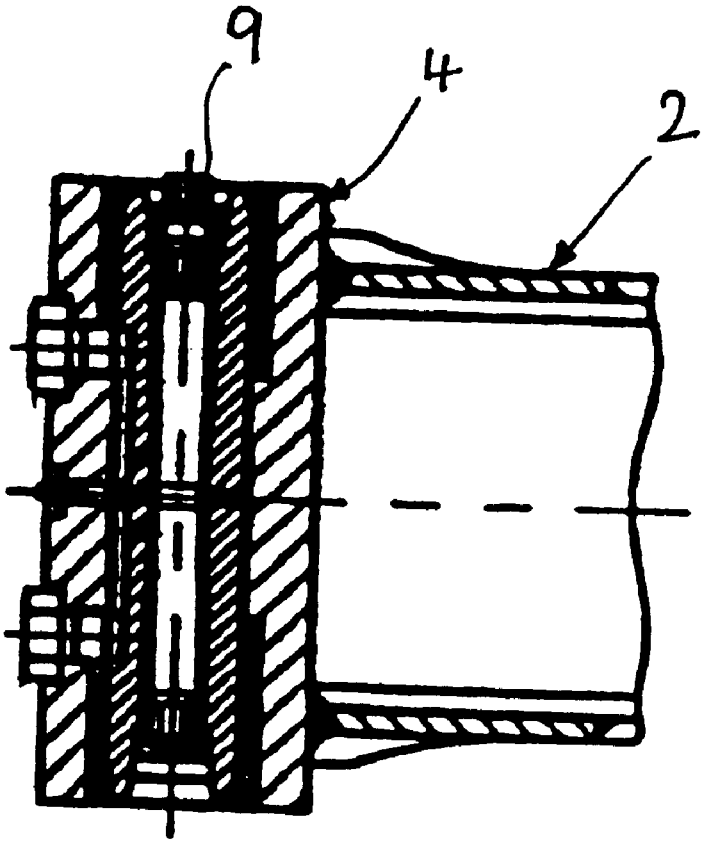
FIG. 2: is a partial view of the coupling section at the front end of the arm in cross-section along Line A—A in FIG. 1, FIG. 3: is a perspective view of an adapter that can be coupled as an implement with the rapid coupling to the operating arm pursuant to FIG. 1, i.e., to its arm and connecting strap.
Figure 2:
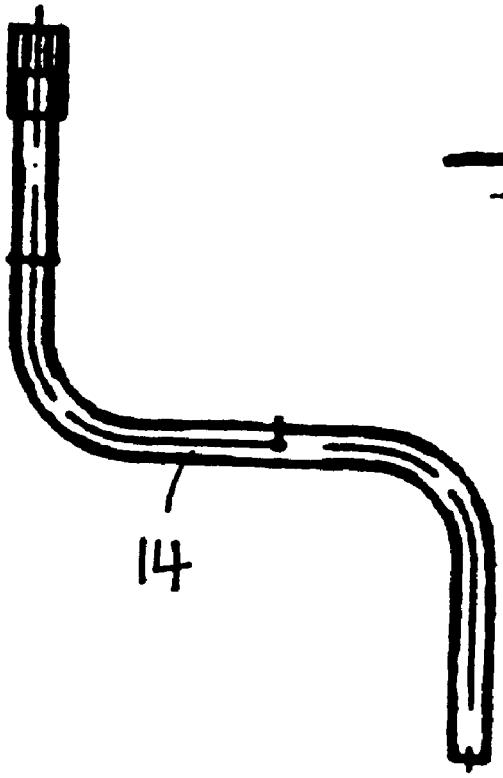
Figure 8:
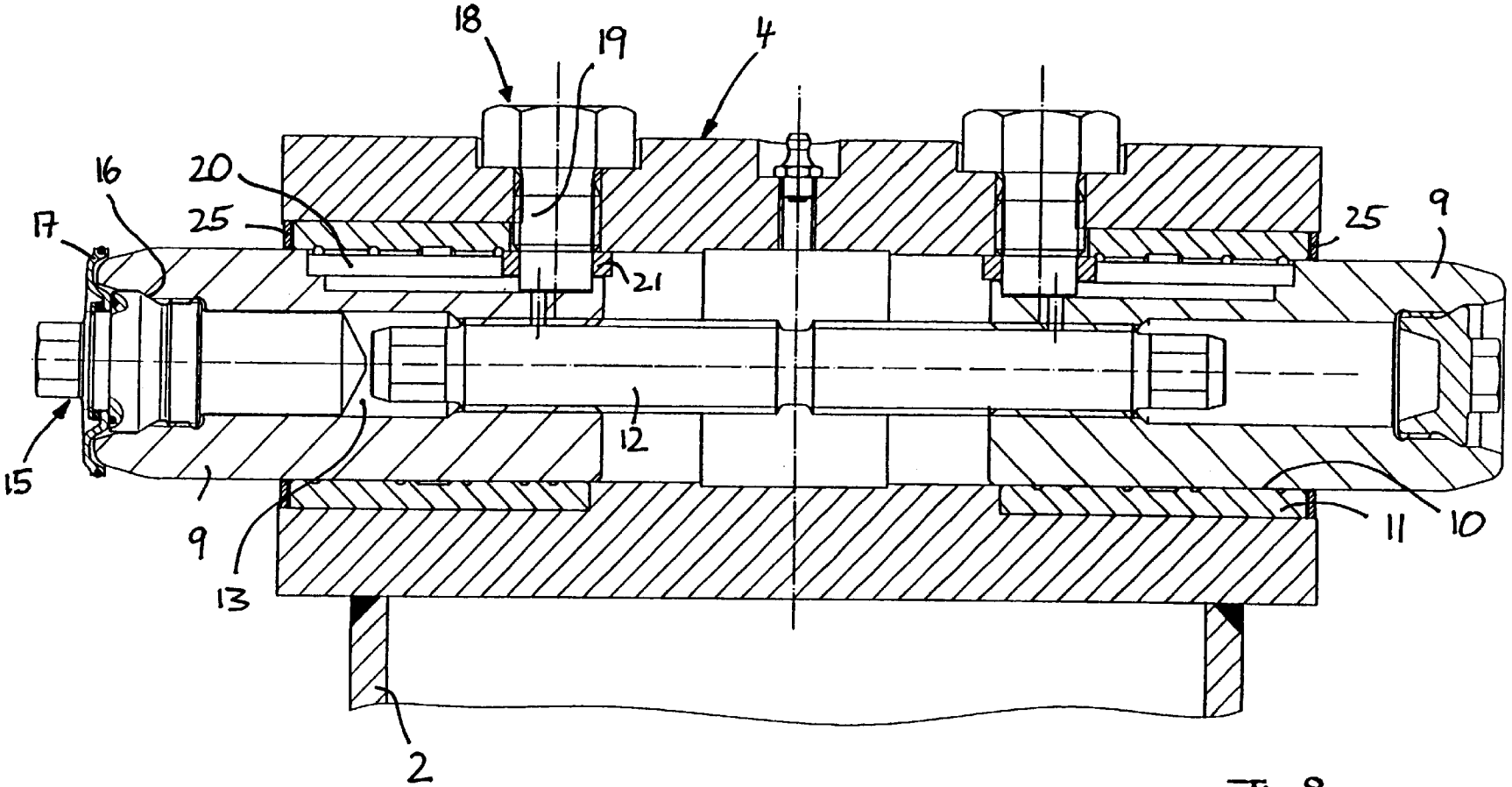
FIG. 8 is a section view of the coupling section on the arm of the operating arm, where the lock pins are shown in their extended lock position.

As shown in FIGS. 2 and 8, the coupling sections 4 and 5 of the arm 2 or the connecting strap 3 are formed essentially cylindrically over their entire length. Diagonally to the longitudinal direction of the arm 2 or the connecting strap 3 a pair of coupling holes 10 are provided in the coupling sections 4 and 5, which holes align with each other and accept the lock pins 9 in a sliding manner so that they can be moved toward and away from each other. The coupling holes 10 are expediently in the form of a catch recess. In the area of the lock pins 9, bushings 11 are set in the coupling holes 10, in which bushings the lock pins 9 can slide axially.

As shown in FIG. 8, the lock pins 9 of a coupling section are connected with each other by means of the drive spindle 12. For this purpose, the lock pins 9 are provided in the catch recesses 13 with left- and right-handed threads into which the drive spindle 12 can be screwed. The lock pins 9 can therefore be moved toward or away from each other when the spindle 12 is rotated. With the catch recesses 13 opened, a manual crank 14 can be placed on the drive spindle 12, as shown in FIG. 2, in order to be able to extend and retract the lock pins 9.

The catch recesses 13 can be sealed outwardly by means of a sealing plug 15, which can be screwed from outside into the lock pins 9 (cf. FIG. 8). The sealing plug 15 has a conical sealing surface 16, which works together with a sealing area having a complementary shape on the corresponding locking bolt 9, in order to protect the inside of the lock pins 9, particularly the drive spindle 12, from external influences, particularly dirt and dust.

An exterior seal 17 is expediently formed on the sealing plugs 15, which seal seals the lock pins 9 against the lock hole 7 in the locked position of the rapid coupling. A plate-like projecting seal lip is provided here as the exterior seal 17, which lip is radially elastic so that it is elastically tensioned against the wall of lock hole 7. The outermost edge of the seal lip here is suitably formed, particularly from a material with a sealing effect. Preferably an O ring can be provided.

The exterior seal 17 is fastened to the sealing plug 15 such that it can rotate. This means that the sealing plug cannot be loosened or hardly even detached upon rotation of the lock pin 9 in the lock hole 7. A seal, preferably an O ring, is expediently provided between the exterior seal 17 and the sealing plug 15. For use at high temperatures, another suitable sealing means can be used in place of the O ring.

As FIG. 8 shows, the sealing plug 15 serves simultaneously as a mechanical insertion resistance for the lock pins 9. The sealing plug 15 is dimensioned, in terms of length, such that it can be inserted into the corrected catch recess 13 in the lock pin 9 when the lock pins 9 are completely extended and have moved outward on the drive spindle 12 so that the catch recess 13 is only partly covered by the drive spindle 12. The rapid coupling is thus reliably protected from an unintentional release, for example, as a result of microimpacts. The sealing plug 15 blocks the drive spindle 12 so that it cannot screw into the lock pins 9 and retract them. Simultaneously, the embodiment of the sealing plug 15 as described creates a control, as a mechanical insertion resistance device, so that the lock pins 9 are always completely extended upon coupling.

The lock pins 9 can indeed slide axially in the coupling holes 10 of the current coupling section 4 or 5, but are guided in a manner resistant to rotation. A guide pin 19 is provided as rotation resistance 18 for each lock pin 9, which guide pin can be screwed into the coupling section so that its front end protrudes into coupling hole 10 (see FIG. 8). A longitudinal groove 20 is machined into the outer surface of each of the lock pins 9, into which the guide pin 19 penetrates. The rotation resistance device 18 also has a guide plate 21 that grazes over the section of guide pin 19 projecting into the lock hole 7 and that enters into longitudinal groove 20. The guide pin 19 accepts the rotational force of the lock pin 9 via the guide plate 21.

Figure 9:
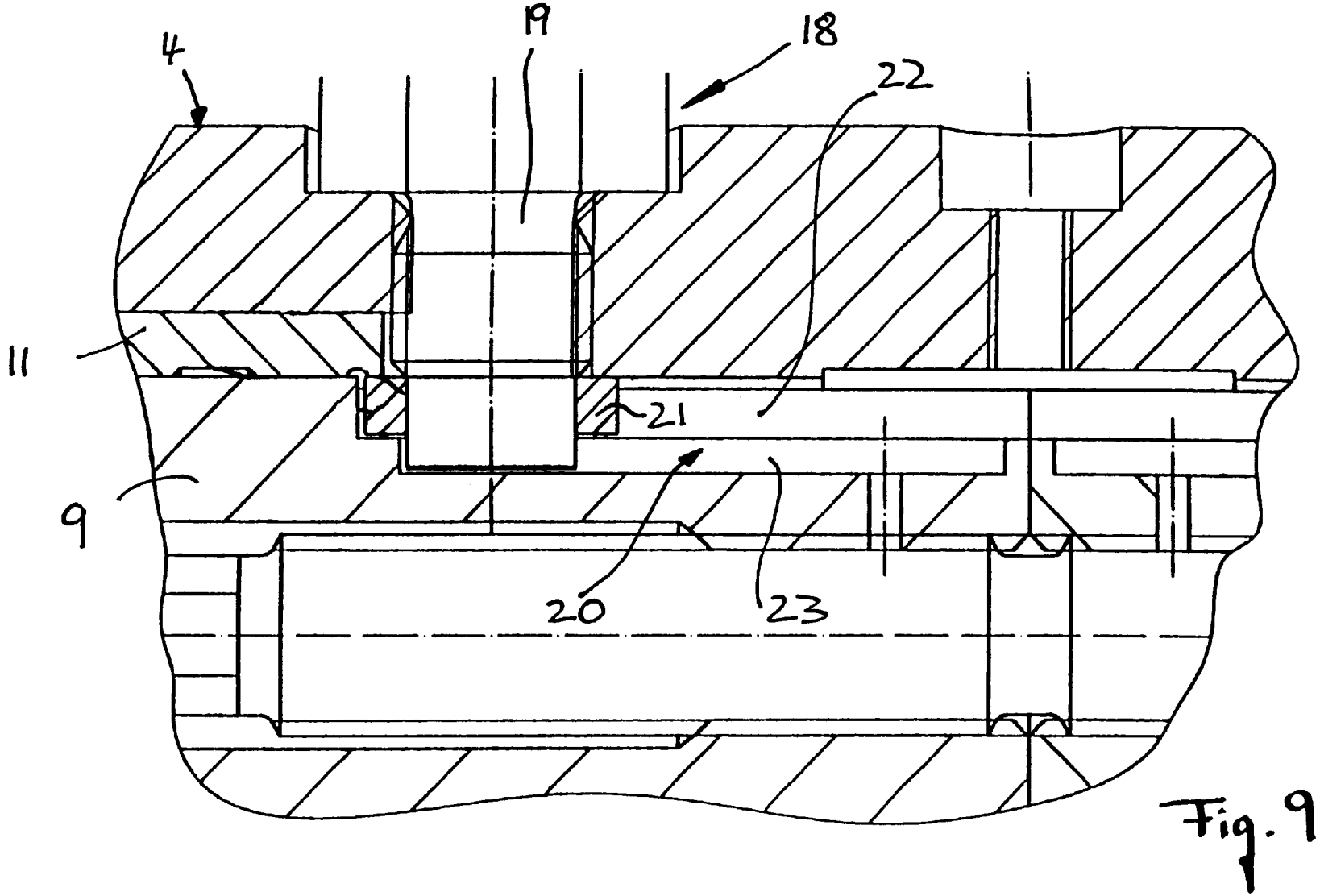
FIG. 9 is an enlarged view of a rotation resistance device for one of the lock pins in a section view, where a guide pin and a guide plate are shown with a longitudinal groove in the lock pins in the penetrating position.
Figure 10:
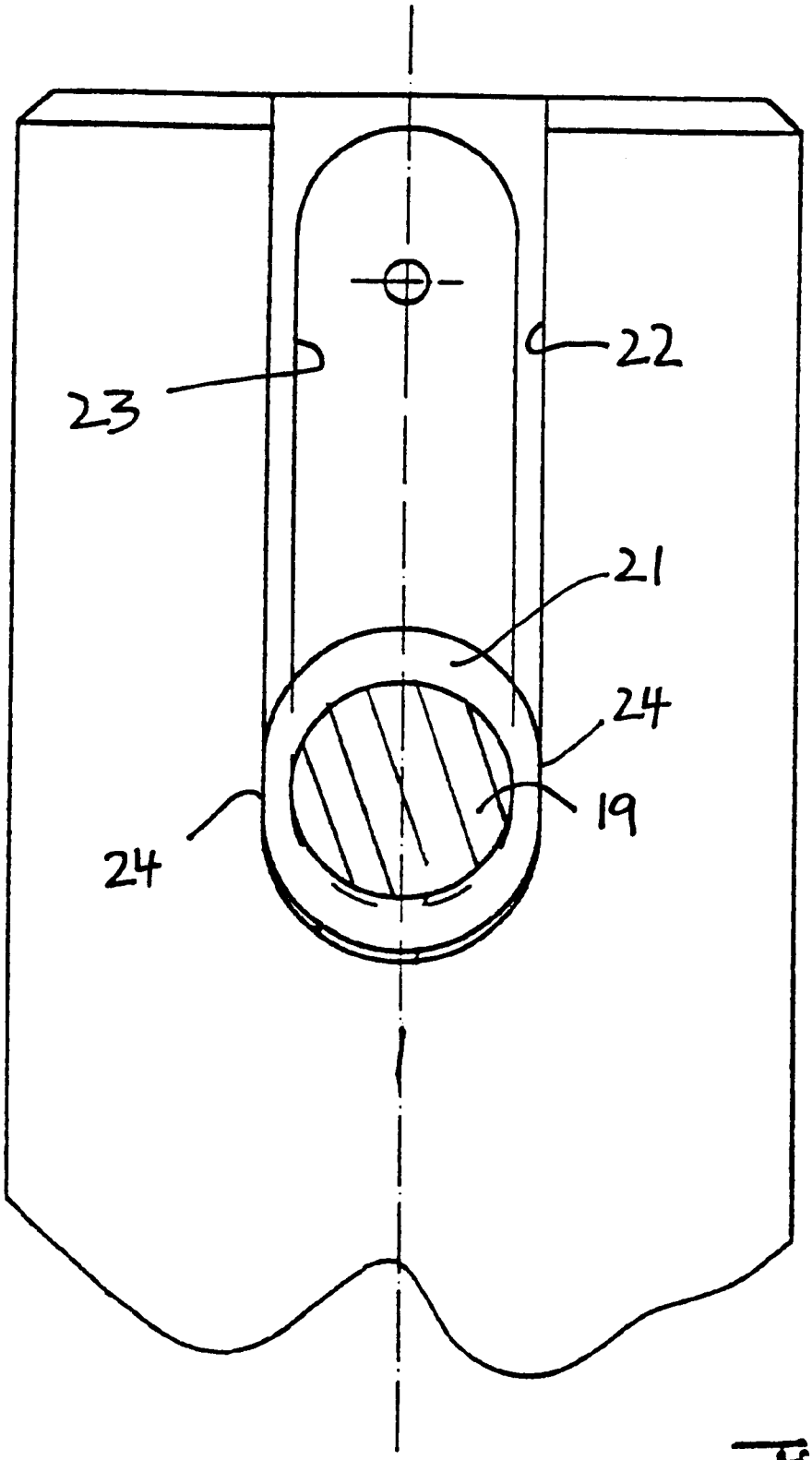
FIG. 10 is a top view of the lock pins from FIG. 9 in the area of the longitudinal groove, where the guide pins (shown in section) and the guide plate are shown inserted into the longitudinal groove.

As shown in FIGS. 8 and 9, the longitudinal grove 20 is formed in two stages. A first groove section 22, lying radially outward, accepts guide plate 21; a second, deeper groove section 23 accepts the section of the guide pin 19 projecting beyond the guide plate 21. As FIG. 10 shows, the exterior groove section 22 is broader and longer; in particularly it runs open to the inner end of the lock pin 9.

The second deeper groove section 23 is closed at both sides; via the end section of guide pin 19 penetrating therein, it creates a longitudinal stop for the retraction and extension of the lock pin 9. The torsion forces acting on the lock pin 9, in contrast to this, are captured at the exterior groove section 22 via the guide plate 21. The guide plate 21 has two diametrically-opposed plate surfaces 24 that cooperate with the walls of the exterior groove section 22. Based on the plate surfaces 24, surface contact is created between the rotational resistance device 18 and the lock pin 9, so that even with high rotational forces, the surface pressure is not excessive. This significantly reduces wear, and damage to the guide pin 19 or the lock pin 9 is avoided.

The formation of the exterior groove section 22, open to one side, permits a more compact arrangement; in particularly, the guide pin 19 can be placed forward inside the coupling holes 10, thus achieving the smallest possible swelling of longitudinal groove 20 toward the outside of the pin. This means that a seal can be provided between the lock pin 9 and the coupling holes 10 without it being overrun upon extension of the lock pin 9 from longitudinal groove 20. As FIG. 8 shows, sealing plates 25 are used in the coupling holes 10 as seals in the end area of coupling holes 10, to which the lock pins 9 extend. This seals the interior of the coupling section 4 or 5, in which the drive for the lock pins 9 is located, from the outside of the lock pin 9 as well.

The lock unit, accepted as a whole in coupling section 4 or 5, that includes the lock pins 9 and the drive with the drive spindle 12, can be removed as a whole after loosening the rotation resistance device 18. The lock unit is therefore formed as a removable cartridge. The coupling holes 10 as well as the lock holes 7 in the implement adapter 6 are preferably compatible with conventional local pins, i.e., after removal of the rapid coupling unit, conventional pins can also be inserted manually from outside in the usual manner. This compatibility makes it possible to create the design in such manner that in mass production both the rapid coupling and conventional pins can be installed, and this, at only slightly increased cost for the components.

Figure 4:
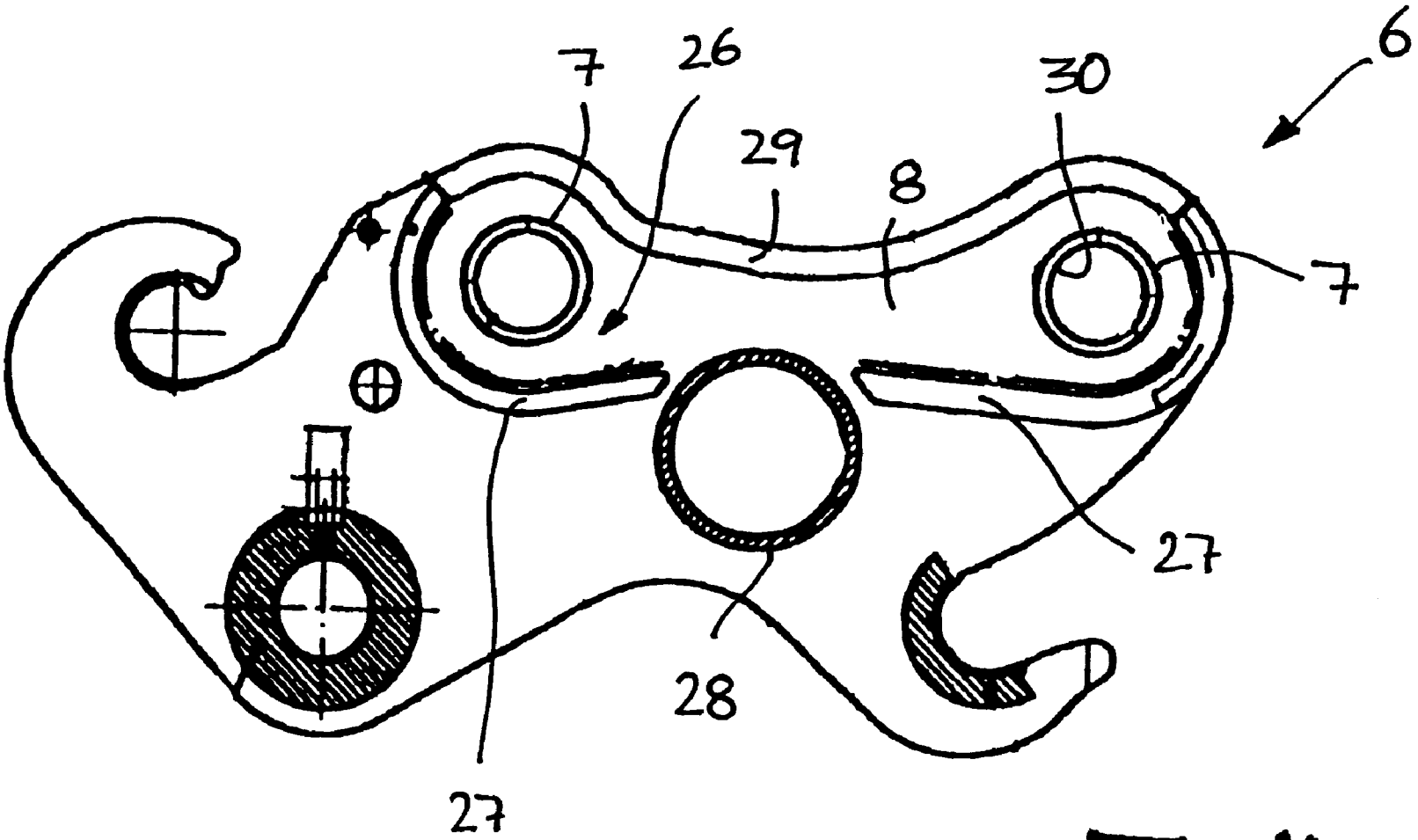
FIG. 4 is a side view of the adapter in FIG. 3 in cross-section through its middle plane.

To facilitate the coupling, the rapid coupling also has pre-centering device for pre-centering the coupling sections 4 and 5 with the lock pins 9 still retracted. The pre-centering device 26 includes the web-shaped guide strips 27 located on the implement adapter 7, which strips project into the recess formed by the holders 8 in the implement adapter 6 for the coupling sections 4 or 5, diagonally to the direction of retraction of the coupling sections 4 or 5 (see FIGS. 3, 4, and 5). Each of the lock holes 7 is assigned such a guide strip 27. The guide strips 27 are formed here as complements to the external contours of the coupling sections 4 and 5 in the area of the lock holes 7, so that the guide strips 27 bevel around the coupling sections 4 and 5 when they are in the proper coupling position. The guide strips 27 project from these vertical sections around the lock holes 7 essentially in a straight line and tangentially to each other, as shown in FIG. 4. The guide strips 27 here are formed in such manner that the coupling sections 4 and 5, when they penetrate between the lock holes 7 between the holders 8, necessarily impact on the guide strips 27 and are caught by the same, i.e., the coupling sections 4 and 5 cannot go beyond the guide strips 27 upon penetration into the recess on the implement adapter 6. As FIG. 4 shows, the guide strips 27 here work with a connector 28 connecting the two holders 8. The guide strips 27 are further formed vertically so that the coupling sections 4 and 5 are guided into the proper coupling position when the are retracted and extended on the guide strips 27.

To simplify the joining or the penetration of coupling sections 4 and 5 of the operating arm 1 into the recess between the holders 8, insertion bevels 29 are produced on the holders 8, which bevels taper in a funnel shape in the direction of insertion of the coupling sections 4 and 5. As FIG. 5 in particular shows, the insertion bevels 29 are formed as phases of the edges of the holders 8.

In the following, the functions and mechanisms of action of the rapid coupling are described in greater detail.

To couple the implement adapter 6 to the operating arm 1, the arm 2 with its coupling section 4 is first introduced between the holders 8, until it presses on the guide strips 27. Through the back and forth movement on the guide strips 27, the coupling section 4 of the arm 2 is moved into its coupling position so that the related lock pins 9 in the coupling section 4 align with the related lock holes 7 in the implement 6. For purposes of locking, the manual crank 14 on the drive spindle 12 is inserted through the lock holes 7 and the lock pins 9 are extended into the locked position.

The coupling section 5 of the connecting strap 3 is handled similarly. It is also pressed onto the guide strips 27 and moved back and forth thereon until the coupling position is reached. By activating the drive spindle 12, the lock pins 9 are also extended so that they penetrate into the related lock holes 7 on the implement adapter 6.

After the lock pins 9 are extended, the sealing plugs 15 are screwed into the catch recesses 13 of the lock pins 9. The sealing plugs 15 thus seal, for one thing, the catch recesses 13 toward the inside and, for another, the lock holes from the outside.

Figure 6:
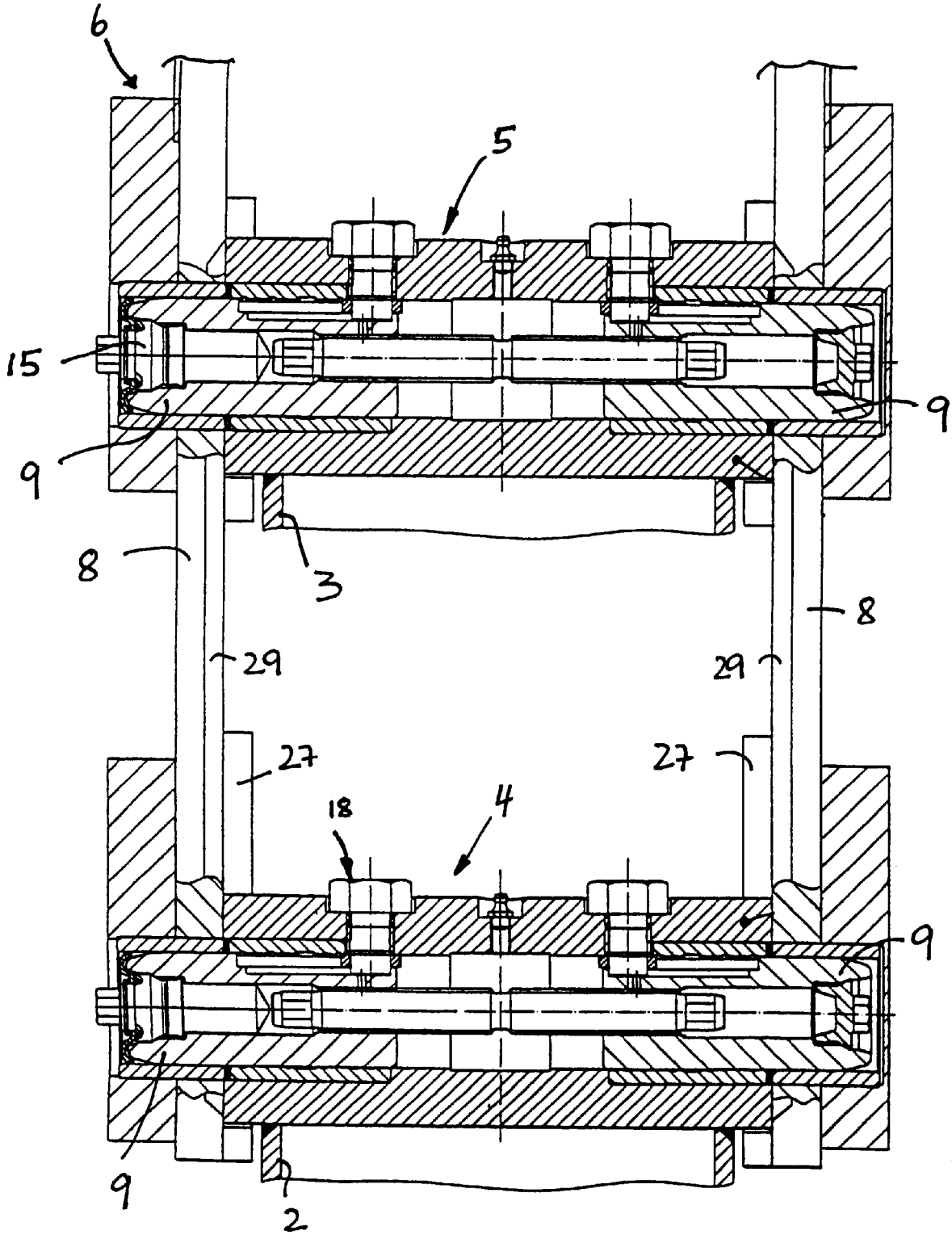
FIG. 6 is a section view of the implement adapter and the boom arm and the boom connecting strap in the coupled state, where the rapid coupling is shown in its locked position.
Figure 7:
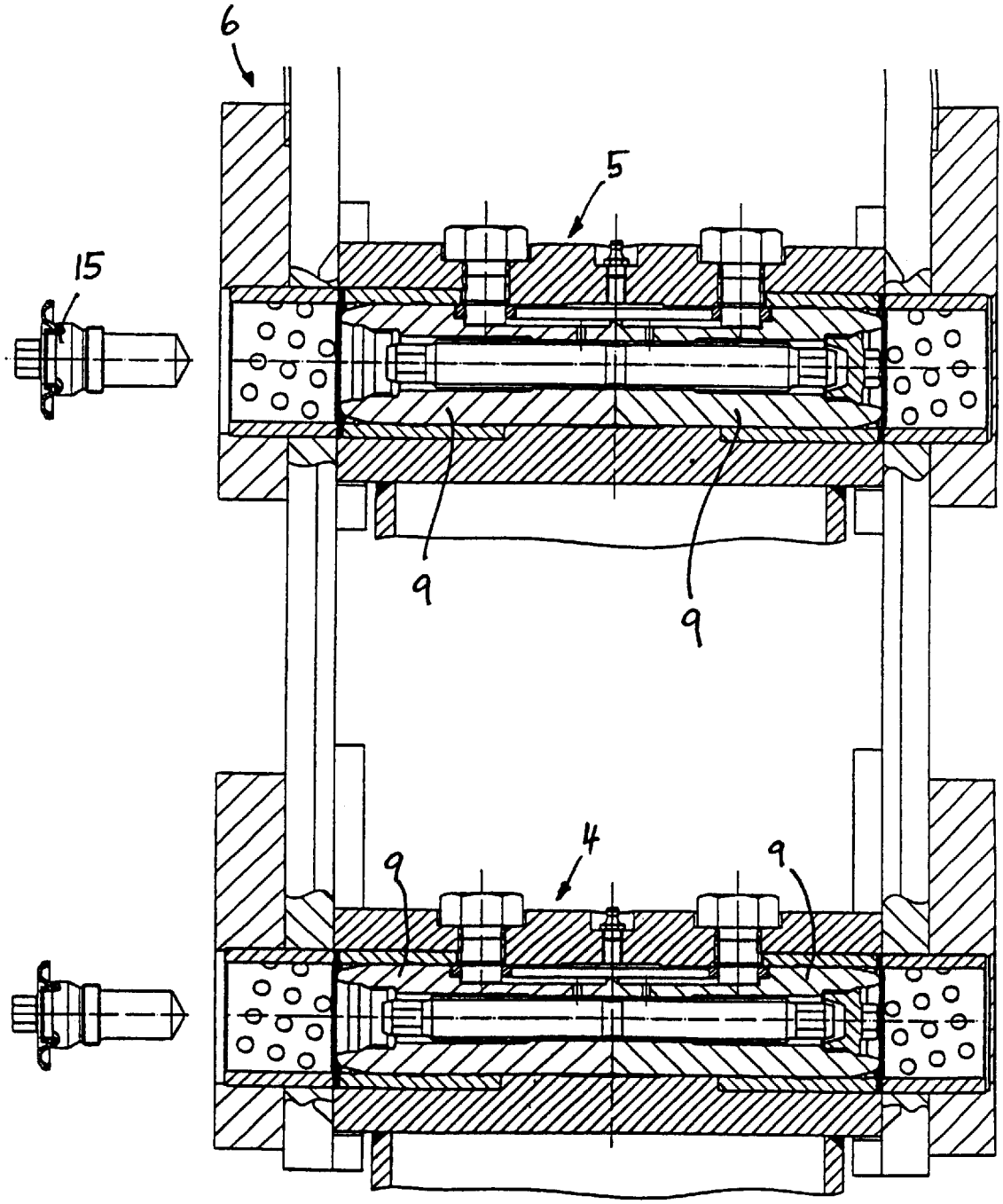
FIG. 7 is a section view of the rapid coupling similar to FIG. 6, where the rapid coupling is shown in its released position with retracted lock pins.

The locked position of the rapid coupling, in which the lock pins 9 penetrate into the related lock holes 7 in too adapter 6, is shown in FIG. 6. FIG. 7, in contrast to this, shows the rapid coupling in its pre-centered coupling position before the lock pins 9 are extended.

Figure 5:
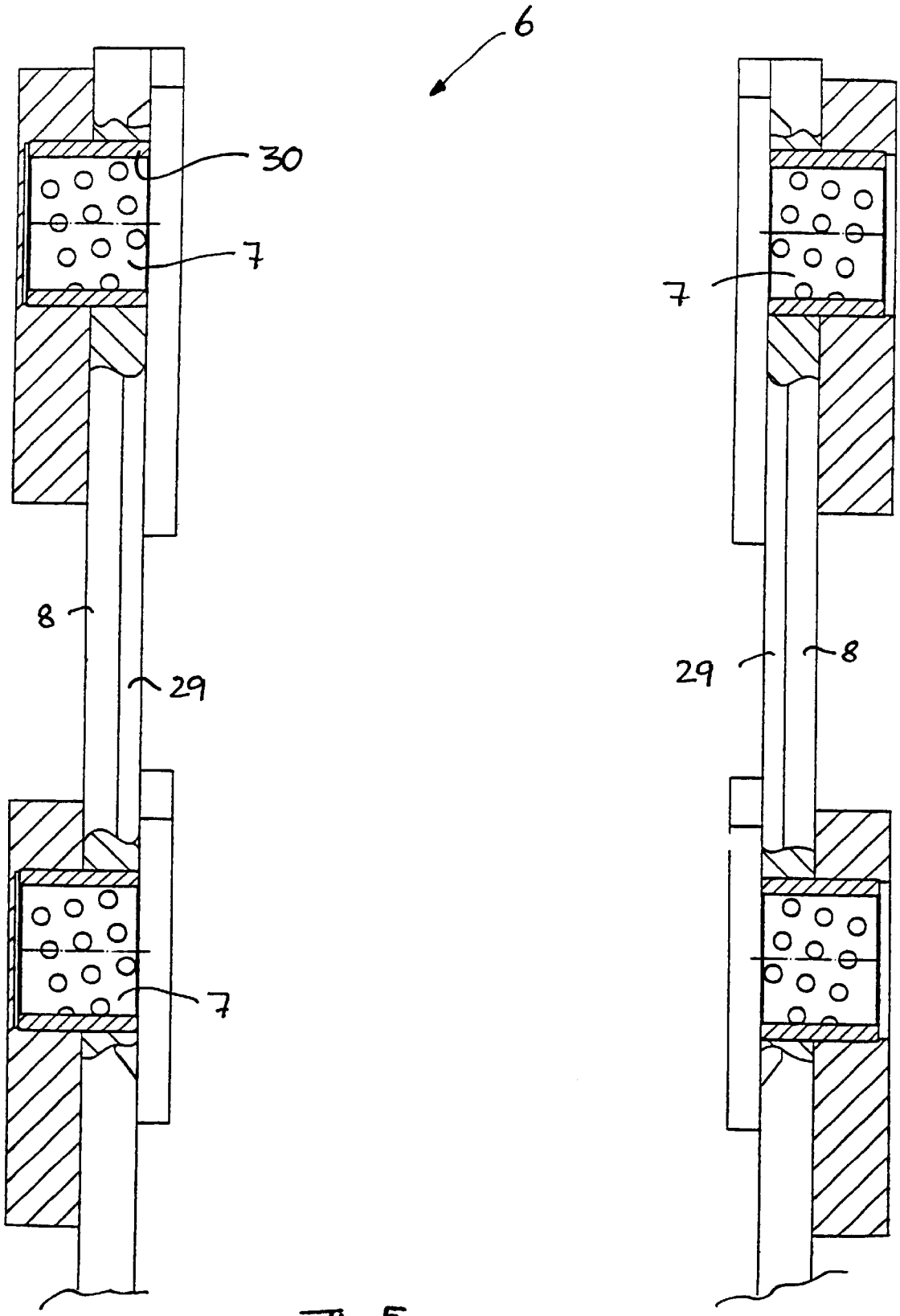
FIG. 5 is a top view of the implement adapter in FIGS. 3 and 4 in partial cross-section, showing the lock pins.

As shown in particular in FIG. 5, bushings 30 are inserted into the lock holes 7. This presents advantages with regard to manufacturing, for one thing, particularly as concerns dimensional accuracy, and for another, with respect to wear.

As shown in FIGS. 6 and 7, the lock holes 7 are open on only one side of the implement adapter. The related lock holes can also be formed on the opposite side of the implement adapter 6 as catch recesses. As described above, this more easily permits compatibility with conventional pins that are to be hammered in.

Higher useful loads and lower prices can be achieved through the direct integration of the rapid coupling into the operating arm 1. In addition, the geometry of the coupling, i.e., the axial distance of the lock pin pairs can be adjusted to requirements simply.

The pre-centering prevents handling in the danger zone of the boom during coupling, particularly in finding the aligned coupling position.

What is claimed is:

1. Quick coupling for coupling an implement to an operating arm, with at least one pair of locking pins that are movably guided toward each other in alignment and that can be moved toward and away from each other by a drive and that penetrate into an aligned lock hole in the implement in their extended lock position, wherein a pre-centering device (26) is provided to pre-center the inserted lock pins (9) with the lock holes (7).

2. Quick coupling according to claim 1, wherein the pre-centering device (26) forms a stop that limits the motion of the operating arm (1) relative to the implement (6) during coupling.

3. Quick coupling according to claim 1, wherein the pre-centering device (26) has a guide (27) to the lock holes (7), where the guide is formed, in particular, vertical to the lock holes and forms a stop in a coupling position for a coupling section on which the lock holes (9) are placed.

4. Quick coupling according to claim 1, wherein the pre-centering device (26) presents guide projections, particularly guide strips (27) that are arranged in pairs in an implement receptacle, into which the coupling section (4, 5) surrounding the lock holes (9) penetrates, and project in the direction of movement of the lock holes (9), where each of the lock holes (7) have such a guide projection.

5. Quick coupling according to claim 1, wherein insertion bevels are provided on the implement receptacle (8) and/or on the coupling section (4, 5) surrounding the lock pins (9).

6. Quick coupling according to claim 1, wherein a mechanical insertion resistance device (15) is provided for the lock pins (8), through which the drive can be blocked in the extended position for the lock pins (9).

7. Quick coupling according to claim 1, wherein the lock pins (9) are accepted in a rotating manner into the lock holes (7) in the implement (6) and in which they are guided into the coupling holes (10) receiving same in a sliding manner and in a rotation-resistant manner created by a rotation resistance device (18), where the rotation resistance device (18) presents guides (19, 21) with opposing plate surfaces (24) that penetrate into a longitudinal groove (20) in the lock pins.

8. Quick coupling according to claim 1, wherein the guide device presents guide pins (19) and annular guide plates (210) surrounding them, on which the plate surfaces (24) are formed, where a two-stage groove is provided in the lock pins (9), the first stage (22) of which is provided to accept the guide plate, and the second stage (23) of which is provided to accept the section of the guide pin projecting beyond the plate.

9. Quick coupling according to claim 1, wherein catch recesses (13) are provided in the lock pins (9), which can be locked, and in particular screwed in from the outside with sealing plugs (15), where bevel seats (16) are preferably provided to seal the sealing plug.

10. Quick coupling according to claim 1, wherein an exterior seal (17) is provided to seal between the lock pins (9) and the lock holes (7), where the exterior seal is held against the lock pins particularly in a rotatable manner.

11. Quick coupling according to claim 1, wherein bushings (30) are provided in the lock holes (7).

12. Quick coupling according to claim 1, wherein a seal (25) is provided between the lock holes (9) and the coupling holes (10) accepting the same, particularly in an edge area of the coupling holes from which the pins extend.

13. Quick coupling according to claim 1, wherein the lock holes (9) and their drives (12) are removable from the coupling holes (10) accepting the same, and are, in particular, formed as a removable cartridge.

14. Quick coupling according to claim 1, wherein two pairs of lock pins (9), arranged parallel to each other, are provided, that form the hinge pins of two parallel swivel axes for the implement (6) to be coupled.

15. Quick coupling according to claim 1, wherein the lock pins (9) are integrated into a coupling section (4, 5) of the operating arm (1), particularly in the end section of an arm (2) and a related connecting strap (3) of the operating arm.

16. Quick coupling according to claim 1, wherein the lock pins (9), guided in a rotation-resistant manner, have recesses (13) with left- and right-handed threads into which one of the two spindles (12) to be connected is screwed, which spindle can be connected with a rotary drive (14).

17. Quick coupling according to claim 1, wherein the pre-centering device (26) has a guide (27) to the lock holes (7), where the guide is formed, in particular, vertical to the lock holes and forms a stop in a coupling position for a coupling section on which the lock holes (9) are placed.

18. Quick coupling according to claim 17, wherein the pre-centering device (26) presents guide projections, particularly guide strips (27) that are arranged in pairs in an implement receptacle, into which the coupling section (4, 5) surrounding the lock holes (9) penetrates, and project in the direction of movement of the lock holes (9), where each of the lock holes (7) have such a guide projection.

19. Quick coupling according to claim 18, wherein insertion bevels are provided on the implement receptacle (8) and/or on the coupling section (4,5) surrounding the lock pins (9).

20. Quick coupling according to claim 19, wherein a mechanical insertion resistance device (15) is provided for the lock pins (8), through which the drive can be blocked in the extended position for the lock pins (9).

* * * * *